US010961717B2

(12) United States Patent
Donnelly

(10) Patent No.: US 10,961,717 B2
(45) Date of Patent: Mar. 30, 2021

(54) HIDDEN FASTENER TO SECURE LOOSE VINYL SIDING

(71) Applicant: John David Donnelly, Cedar Springs, MI (US)

(72) Inventor: John David Donnelly, Cedar Springs, MI (US)

( * ) Notice: Subject to any disclaimer, the term of this patent is extended or adjusted under 35 U.S.C. 154(b) by 0 days.

(21) Appl. No.: 16/750,476

(22) Filed: Jan. 23, 2020

(65) Prior Publication Data

US 2020/0232223 A1 Jul. 23, 2020

Related U.S. Application Data

(60) Provisional application No. 62/795,762, filed on Jan. 23, 2019.

(51) Int. Cl.
*E04F 13/08* (2006.01)
*E04B 1/61* (2006.01)
*E04F 13/18* (2006.01)

(52) U.S. Cl.
CPC ..... *E04F 13/0833* (2013.01); *E04B 1/6104* (2013.01); *E04F 13/0835* (2013.01); *E04F 13/0848* (2013.01); *E04F 13/0864* (2013.01); *E04F 13/18* (2013.01)

(58) Field of Classification Search
CPC ... E04F 13/0833; E04F 13/18; E04F 13/0864; E04F 13/0835; E04F 13/0842; E04F 13/0848; E04F 13/0851; E04F 13/0858; E04F 13/086; E04B 1/6104
USPC ..... 52/518, 520, 521, 543, 544, 545, 546, 52/547, 551, 552
See application file for complete search history.

(56) References Cited

U.S. PATENT DOCUMENTS 953,217 A * 3/1910 Moffett ..... E04D 3/364 52/520
3,110,130 A * 11/1963 Trachtenberg ..... E04F 13/0864 52/545
3,606,720 A * 9/1971 Cookson ..... E04D 3/3607 52/714
3,703,062 A * 11/1972 McKinney ..... E04F 13/0864 52/545
4,096,679 A * 6/1978 Naz ..... E04F 13/0864 52/523
4,947,609 A * 8/1990 Champagne ..... E04F 13/0821 52/478
5,392,579 A * 2/1995 Champagne ..... E04D 1/34 52/520
5,537,791 A * 7/1996 Champagne ..... E04F 13/0864 52/489.1

(Continued)

*Primary Examiner* — Brent W Herring
(74) *Attorney, Agent, or Firm* — Dunlap Bennett & Ludwig, PLLC

(57) ABSTRACT

A hidden siding fastener is provided. The hidden siding fastener includes an upper nail hem hook and an opposing lower pressure point, fold point and lock engagement hook extending therefrom. The nail hem hook is threaded through the back side of a lower piece of siding panel so that the lock engagement hook can nest into a siding lock slot of the same siding panel. Thereby, a separate upper piece of siding panel and specifically its siding lock hook can operatively associate with the lock engagement hook and fold point in a locked engagement, while the pressure point urges a more secure locked engagement between the two pieces of siding panel.

5 Claims, 4 Drawing Sheets

(56) References Cited

U.S. PATENT DOCUMENTS

| | | | | | |
|---|---|---|---|---|---|
| 5,564,246 | A * | 10/1996 | Champagne | E04F 13/0864 | 52/478 |
| 5,575,127 | A * | 11/1996 | O'Neal | E04F 13/0864 | 52/520 |
| 7,562,505 | B2 * | 7/2009 | Tohanczyn, Jr. | E04F 13/0864 | 52/539 |
| 2006/0101767 | A1 * | 5/2006 | Tohanczyn, Jr. | E04F 13/0864 | 52/521 |

* cited by examiner

HIDDEN FASTENER TO SECURE LOOSE VINYL SIDING

CROSS-REFERENCE TO RELATED APPLICATION

This application claims the benefit of priority of U.S. provisional application No. 62/795,762, filed 23 Jan. 2019, the contents of which are herein incorporated by reference.

BACKGROUND OF THE INVENTION

The present invention relates to construction technology and, more particularly, to a hidden fastener to secure loose siding on commercial and residential construction.

Vinyl and aluminum siding often unlock because of poor installation, low quality, time, gravity, and/or weather conditions. Caulk and nails can be aesthetically displeasing and messy, and may restrict movement of the siding, potentially causing the siding to buckle. Shrink strips can be used, but do not fasten to the siding when installed, essentially floating between the two locking mechanisms. This leaves the siding more vulnerable to unlocking. Moreover, shrink strip typically must be custom made to extend the lock, this requiring special materials and some mechanical skills, and thus an additional expense. As a result, all of the above-mentioned methods require special tools or materials.

As can be seen, there is a need for a hidden fastener to secure loose siding on commercial and residential construction. The hidden siding fastener embodied in the present invention is dimensioned and adapted to be manufactured and installed to fit the gap between the two loose or separated locking mechanisms of two interlocking pieces of siding. The hidden siding fastener extends downward the top locking slot of the lower piece of siding, giving the bottom lock of the upper piece of siding more area to attach to. The hidden siding fastener is secured to the siding yet allows the siding to expand and contract.

SUMMARY OF THE INVENTION

In one aspect of the present invention, a siding fastener not visible when facilitating a locked engagement between two adjacent siding panels includes the following: a front plate extending between an upper end and a lower end; the front plate having a rearward surface and an opposing forward surface; the upper end turns radially until transitioning into a nail hem hook portion extending diagonally downward away from the upper end and adjacent the rearward surface; a threading bend depends from the nail hem hook in an orientation generally parallel with the front plate; lower end turns diagonally downward and rearward, at a pressure point, until transitioning radially upward, and further rearward, to form or define a lower fold; the lower fold radially turns generally 180-degrees at a fold point toward the lower end; and a lock engagement hook extends upwardly and rearward from the distal end of the lower fold.

In another aspect of the present invention, a method for forming a locked engagement an upper siding panel and a lower siding panel with a siding fastener not visible when facilitating the locked engagement includes the following: providing the above-mentioned siding fastener; providing the upper siding panel having a nail hem, nail hem hole and siding lock slot spaced apart, respectively, from an upper edge; attaching providing the lower siding panel having a siding lock hook extending from a lower edge; sliding the threading bend through the nail hem hole; nesting the lock engagement hook in the siding lock slot; bending a top portion of the front plate over the nail hem; and associating the siding lock hook with the lock engagement hook in the locked engagement.

These and other features, aspects and advantages of the present invention will become better understood with reference to the following drawings, description and claims.

DETAILED DESCRIPTION OF THE INVENTION

Figure 1:
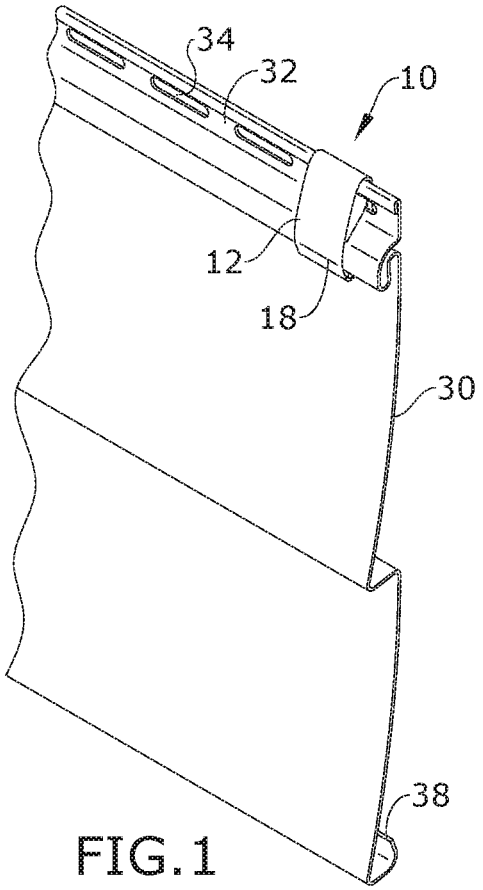
FIG. 1 is a front perspective view of an exemplary embodiment of the present invention, shown installed on a nail hem 32.
Figure 2:
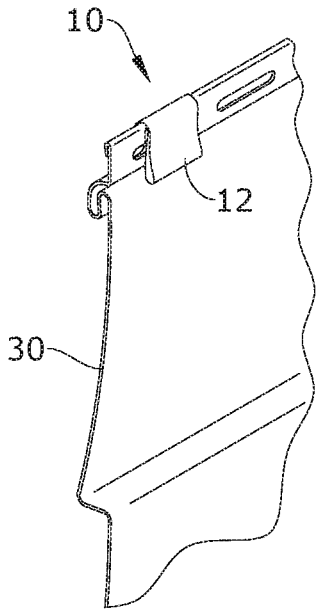
FIG. 2 is a rear perspective view of an exemplary embodiment of the present invention, shown installed on the nail hem 32.
Figure 3:
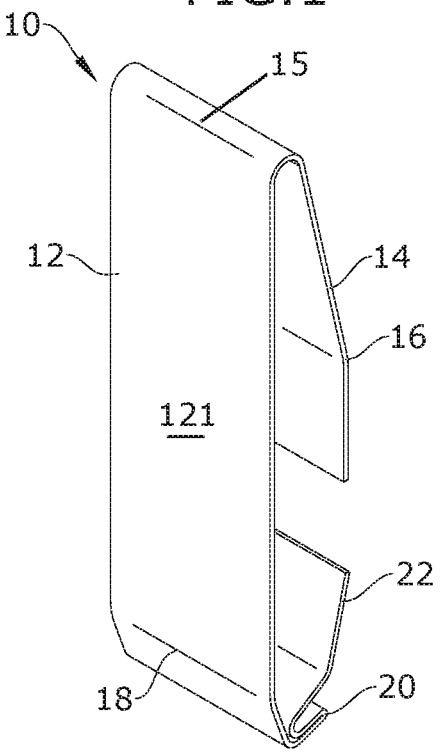
FIG. 3 is a front perspective view of an exemplary embodiment of the present invention.
Figure 4:
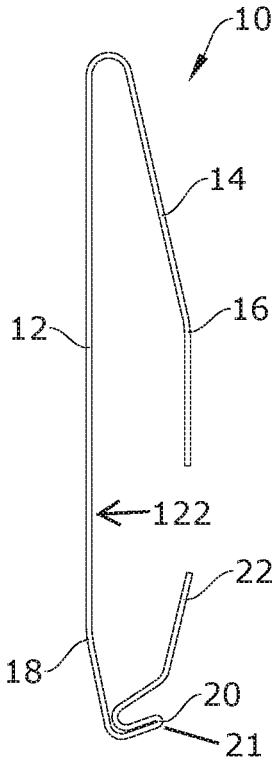
FIG. 4 is a side view of an exemplary embodiment of the present invention.
Figure 5:
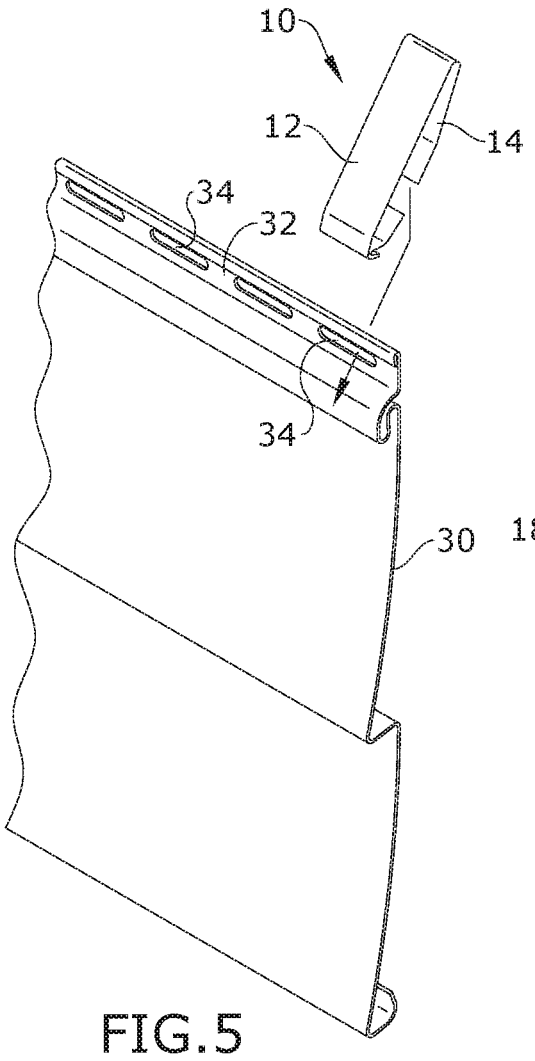
FIG. 5 is a perspective view of an exemplary embodiment of the present invention, illustrating the insertion of a nail hem hook 14 through a nail hem hole 34.
Figure 6:
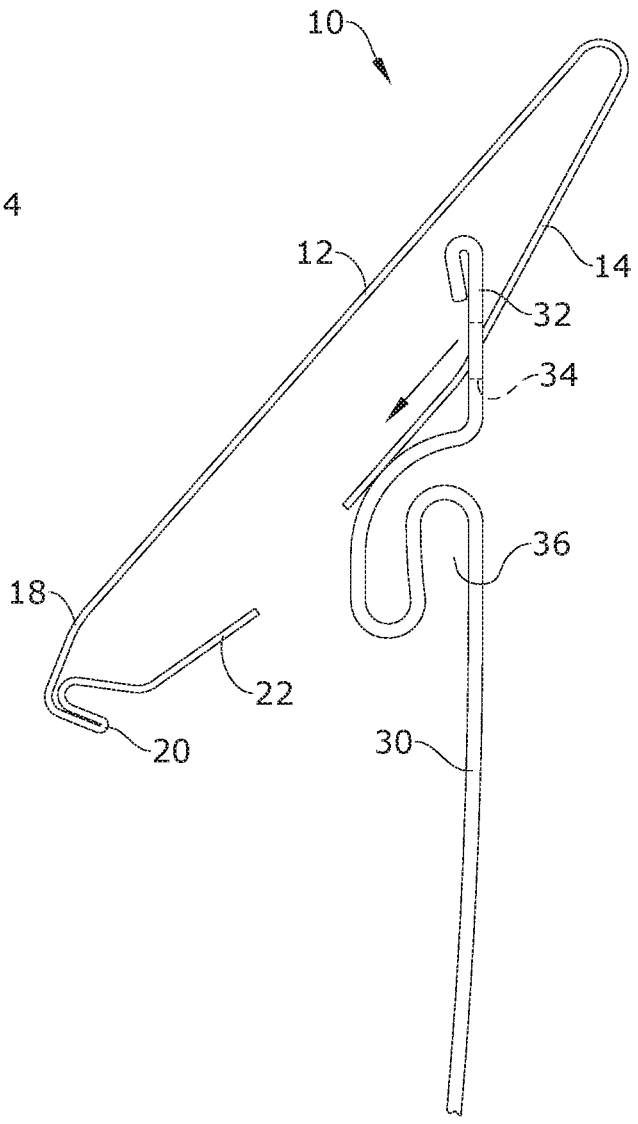
FIG. 6 is a side view of an exemplary embodiment of the present invention, illustrating the first step of installation.
Figure 7:
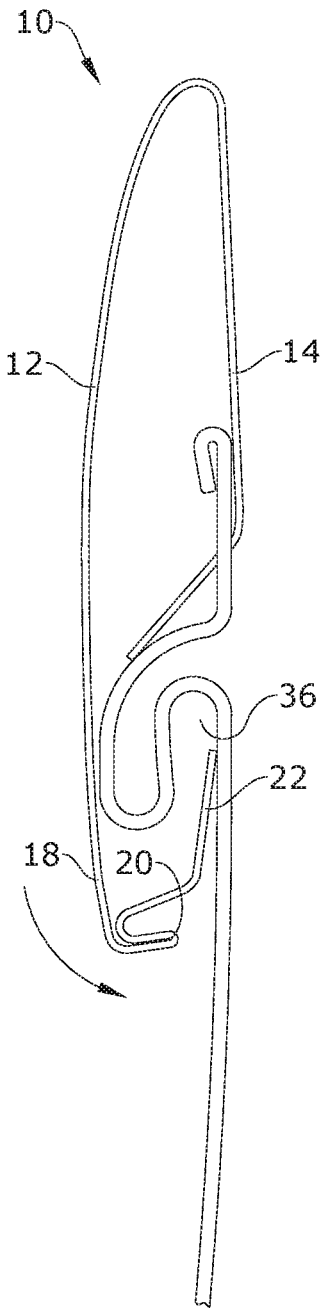
FIG. 7 is a side view of an exemplary embodiment of the present invention, illustrating the second step of installation.
Figure 8:
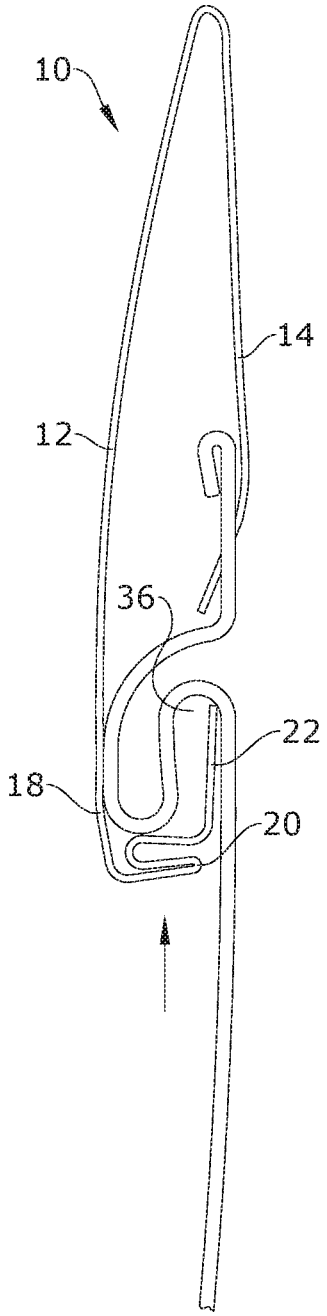
FIG. 8 is a side view of an exemplary embodiment of the present invention, illustrating the third step of installation.
Figure 9:
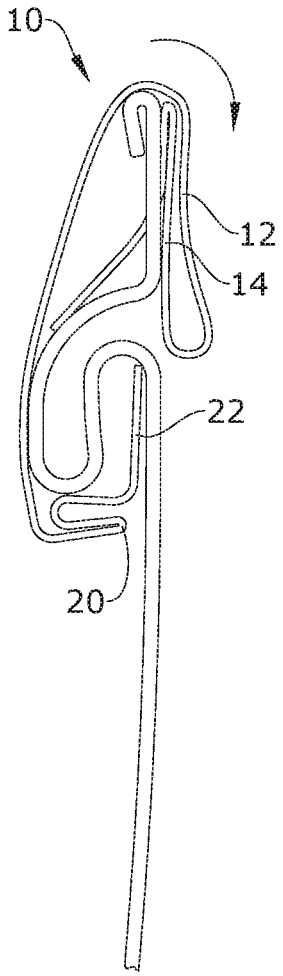
FIG. 9 is a side view of an exemplary embodiment of the present invention, illustrating the fourth step of installation.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a hidden siding fastener that provides an upper nail hem hook and a lower pressure point, fold point and lock engagement hook extending therefrom. The nail hem hook is threaded through the back side of a lower piece of siding panel so that the lock engagement hook can nest into a siding lock slot of the same siding panel. Thereby, an upper piece of siding panel and specifically its siding lock hook can operatively associate with the lock engagement hook and fold point in a locked engagement, while the pressure point urges a more secure locked engagement between the two pieces of siding panel.

It should be understood by those skilled in the art that the use of directional terms such as upper, upward, downward, lower, rearward, forward and the like are used in relation to the illustrative embodiments as they are depicted in the figures, the upward (or upper) direction being toward the top of the corresponding figures, the downward (or lower) direction being toward the bottom of the corresponding figures, while rearward is the direction the nail hem hook and lower fold extend in the corresponding figures.

Referring to FIGS. 1 through 11, the present invention may include a hidden siding fastener 10. The hidden siding fastener 10 may be, but is not limited to, 0.020 aluminum sheet metal, various metallic and plasticized materials, or the like. Using a small gauge aluminum may be necessary for ease of installation when bending the hidden siding fastener 10 over a top edge of a nail hem of a lower piece of siding 30, and to prevent rusting.

The sheet metal may be cut into strips approximately ¾-inch×6 inches. A series of various bends are made to form the hidden siding fastener 10. This could be accomplished by using a hand tool, forming the metal strip around a mold, or a combination of hand tools, molds, and automated equipment.

The hidden siding fastener 10 may provide a front plate 12 extending between an upper end 15 and an opposing lower end. The front plate 12 has a front surface 121 and an opposing rear surface 122.

The upper end 15 turns radially until transitioning into a nail hem hook portion 14 that extends diagonally downward away from the upper end 15 and adjacent the rear surface 122 (i.e., rearward). The nail hem hook portion 14 then bends further downward, generally parallel with the front plate 12, as the nail hem hook portion 14 transitions to a threading bend 16 which terminating at a distal end.

The lower end turns diagonally downward and rearward, at a pressure point 18, until transitioning radially upward, and further rearward, to form a lower fold 21. The lower fold 21 radially turns generally 180-degrees at a fold point 20 toward the downward turn of the lower end. A lock engagement hook 22 extends upwardly and rearward from the distal end of the lower fold 21. The shape of the lower fold 21 biases the lock engagement hook 22 and the front plate 12 a predetermined distance apart.

Figure 10:
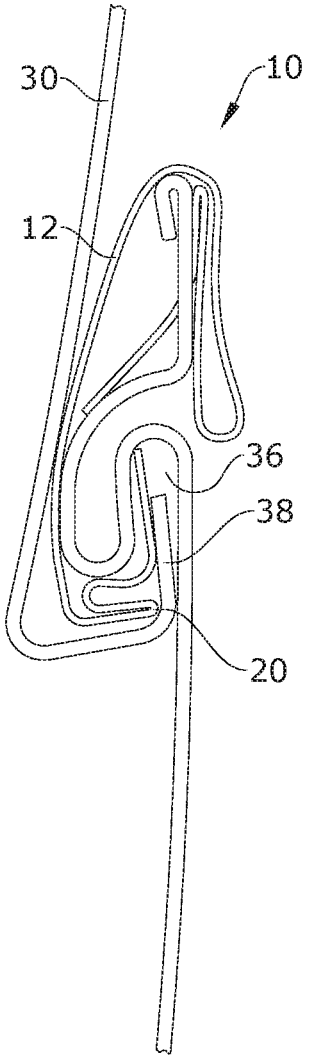
FIG. 10 is a side view of an exemplary embodiment of the present invention, shown installed on nail hem 32 and securing a siding lock hook 38.

Referring to FIGS. 6 through 9, residential and commercial building siding 30 terminates along an upper edge in a nail hem 32. The nail hem 32 is spaced apart from a siding lock slot 36, and between the siding lock slot 36 and nail hem 32 are a plurality of spaced apart nail hem holes 34. Along a lower edge of the siding 30, is a hook-shaped siding lock hook 38 is provided, as illustrated in FIGS. 10-11, for associating with the siding lock slot 36 in a locking engagement.

A method of using the present invention may include the following. The hidden siding fastener 10 disclosed above may be provided. The threading bend 16 may be inserted through the backside of the siding's nail hem hole 34 (with the lock engagement hook 22 facing the exterior of the siding 30) then push the lock engagement hook 22 past the bottom edge of the siding's lock slot 36. The lock engagement hook 22 is then inserted into the siding lock slot 36. Then the hidden siding fastener 10 is pulled up tight to the siding lock 36. The top of the front plate 12 is the folded over the top of the vinyl siding's nail hem 32. This prevents the hidden siding fastener 10 from moving and loosening. The bottom siding lock 38 of an upper piece of siding 38 is then fastened to the hidden siding fastener 10 as the siding lock hook 38 is slid between the siding 30 and the lock engagement hook 22 to form a locked engagement with the lock engagement hook 22 and the lower fold 21, that effectively extends the siding lock slot 36.

Figure 11:
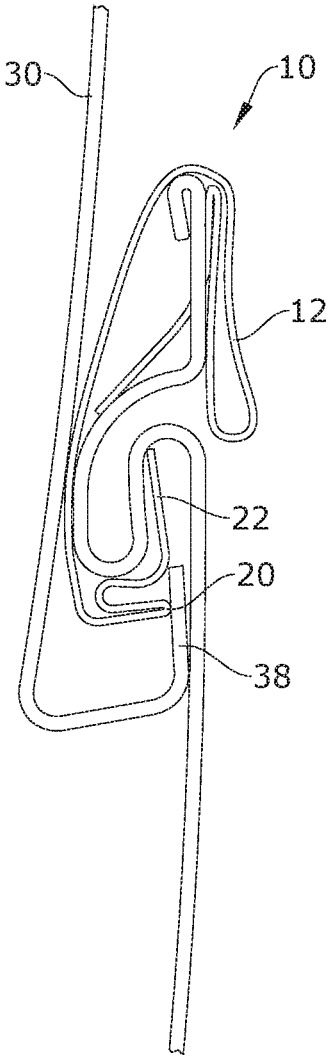
FIG. 11 is a side view of an exemplary embodiment of the present invention, illustrating the siding lock hook 38 of the upper piece of siding 30 staying secured even after slipping out of the siding lock slot 36 because of the extension characteristic of the lower fold 21 and the locking engagement of the lock engagement hook 22.

The lower fold 21 extends the purchase of the siding lock hook 38 preventing the upper piece of siding's lock from becoming loose or detached, as illustrated in FIG. 11. The pressure point 18 is dimensioned and adapted to push against the upper piece of siding's interior wall, wherein the pressure point operatively associates with an interior portion of the upper siding panel so as to urge said siding lock hook 38, further securing the locked engagement of the siding lock hook 38 and the lock engagement hook 22 in the siding lock slot 36.

The lock engagement hook 22 also pushes, by occupying a portion of the siding lock slot 36, the siding lock hook 38 toward the exterior face of the lower piece of siding. This tightens the two locking mechanisms together, reducing the chances of loosening or unlocking. Also, the lower fold is disposed downward of the siding lock slot 36, whereby the siding lock hook 38 can engage said lower fold 21 outside of the siding lock slot 36, for instance where there is slippage between the lower siding panel and the upper siding panel.

Another way of describing how to install the present invention includes the following: a user could hold the hidden siding fastener 10 in front of them in a vertical position, with the flat forward portion of the front plate surface 12 facing them. The nail hem hook 14 should be upwardly oriented and extending away from the user, with the lock engagement hook 22 on the bottom. The user would place the nail hem hook 14 over the top of the siding's nail hem 32, while keeping the bottom lock engagement hook 22 on the front of the siding panel 30. As the user pulls down on the hidden siding fastener 10, they thread the nail hem hook 14 (that is behind the siding's nail hem hole 34) through the backside of the siding's nail hem hole 34 so that the nail hem hook 14 is urged forward through the front side of the siding panel 30. The user could continue to thread the nail hem hook 14 through the backside of the nail hem hole 34 and position the lock engagement hook 22 below the siding's lock slot 36 so that the lock engagement hook 22 will slide up into the siding's lock slot 36. Then the user may urge the hidden siding fastener 10 up so the lock engagement hook 22 is fully inserted in the siding's lock slot 36. Keeping the hidden siding fastener 10 pulled up snug, the user may fold the top portion of the front plate 12 180 degrees back over the top of the siding's nail hem 32, folding it back behind the lower piece siding 30. The hidden siding fastener 10 is now installed and a separate upper piece of siding 30 may be re-attached over the hidden siding fastener 10. The hidden siding fastener 10 could be fastened with nails, screws, snaps, caulk, glue or create other pressure or catch points to secure it in place.

It should be understood, of course, that the foregoing relates to exemplary embodiments of the invention and that modifications may be made without departing from the spirit and scope of the invention as set forth in the following claims.

What is claimed is:

1. A siding fastener not visible when facilitating a locked engagement between two adjacent siding panels, comprising:

a front plate extending between an upper end and a lower end;

the front plate having a rearward surface and an opposing forward surface;

the upper end turns radially until transitioning into a nail hem hook extending diagonally downward away from the upper end and adjacent the rearward surface;

the lower end turns diagonally downward and rearward, at a pressure point, until transitioning radially upward, and further rearward, to define a lower fold;

the lower fold radially turns generally 180-degrees at a fold point toward the lower end; and a lock engagement hook extends upwardly and rearward from a distal end of the lower fold.

2. The siding fastener not visible when facilitating a locked engagement between two adjacent siding panels of claim 1, further comprising:

a threading bend depending from the nail hem hook in an orientation generally parallel with the front plate.

3. A method for forming a locked engagement an upper siding panel and a lower siding panel with a siding fastener not visible when facilitating the locked engagement, comprising:

providing the siding fastener of claim 2;

providing the lower siding panel having a nail hem, nail hem hole and siding lock slot spaced apart, respectively, from an upper edge;

attaching providing the upper siding panel having a siding lock hook extending from a lower edge;

sliding the threading bend through the nail hem hole;

nesting the lock engagement hook in the siding lock slot;

bending a top portion of the front plate over the nail hem; and associating the siding lock hook with the lock engagement hook in the locked engagement.

4. The method of claim 3, wherein the pressure point operatively associates with an interior portion of the upper siding panel so as to urge said siding lock hook, whereby further securing the locked engagement.

5. The method of claim 3, wherein the lower fold is disposed downward of the siding lock slot, whereby the siding lock hook can engage said lower fold outside of the siding lock slot.

* * * * *